United States Patent [19]

Duimstra

[11] Patent Number: 5,003,275

[45] Date of Patent: Mar. 26, 1991

[54] NON-LATCHING RELAY SWITCH ASSEMBLY

[75] Inventor: Frederick A. Duimstra, Anaheim Hills, Calif.

[73] Assignee: Babcock, Inc., Orange, Calif.

[21] Appl. No.: 399,013

[22] Filed: Aug. 28, 1989

[51] Int. Cl.[5] ..... H01H 51/28; H01H 51/22; H01H 51/01; H01H 1/66

[52] U.S. Cl. ..... 335/154; 335/151; 335/84; 335/179; 335/182; 335/202

[58] Field of Search ..... 335/177, 179, 151, 154, 335/78, 79, 81, 84, 85, 180, 181, 182, 183, 202

[56] References Cited

U.S. PATENT DOCUMENTS

| | | | |
|---|---|---|---|
| 2,952,755 | 9/1960 | Brinker et al. | 335/179 |
| 3,204,059 | 8/1965 | Saaty | 335/179 |
| 3,534,192 | 10/1970 | Miles | 335/151 |
| 3,813,620 | 5/1974 | Adkins | 335/179 |
| 4,105,982 | 8/1978 | Oeschger | 335/154 |
| 4,638,275 | 1/1987 | Belbel et al. | 335/151 |

*Primary Examiner*—Peter S. Wong
*Assistant Examiner*—Nilay H. Vyas
*Attorney, Agent, or Firm*—G. Donald Weber, Jr.

[57] ABSTRACT

A non-latching relay switch assembly which includes a coil section and a switch or contact section. The coil section includes a permanent magnet and an electromagnet. The respective sections are arranged in separate locations or cavities in the assembly. The switch has a "normal" position and is selectively switched by an overriding electromagnetic assembly. The switch returns to the "normal" position when the overriding electromagnetic assembly is inactive.

32 Claims, 3 Drawing Sheets

FIG. 4
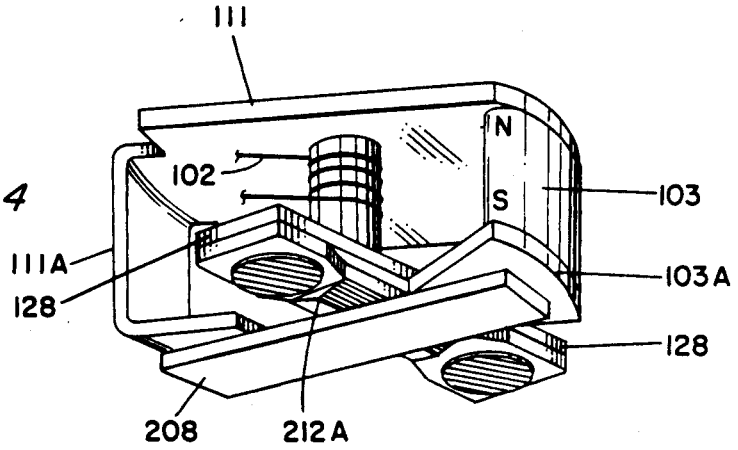
FIG. 5
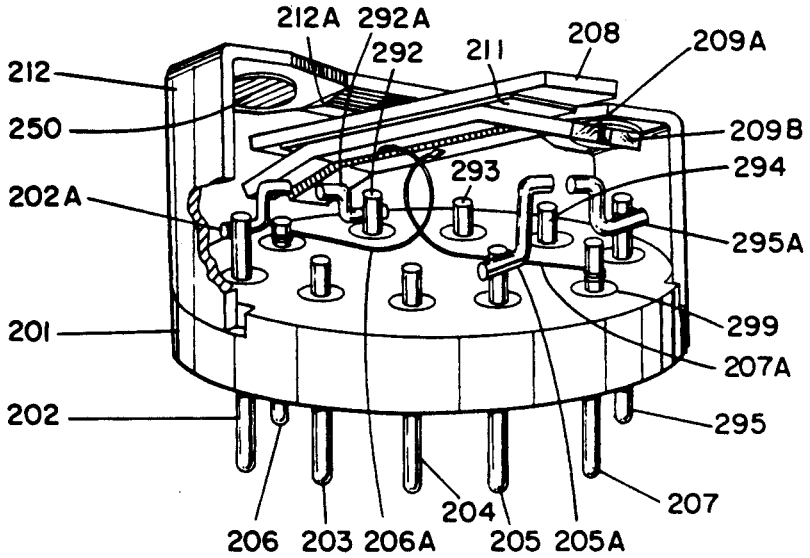
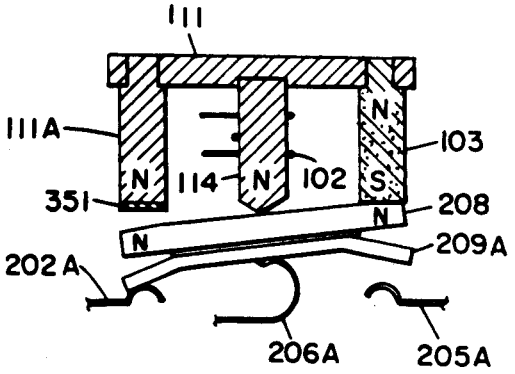
FIG. 3A
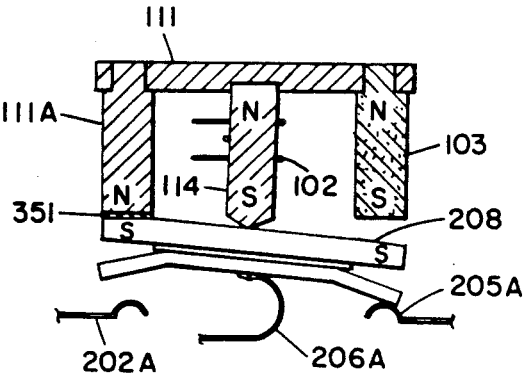
FIG. 3B

NON-LATCHING RELAY SWITCH ASSEMBLY

GOVERNMENT RIGHTS

This invention was made under the auspices of the U.S. Department of Energy wherein the U.S. Government obtains a non-exclusive, royalty free, irrevocable license to practice or have practiced the invention.

BACKGROUND

1. Field of the Invention

This invention is directed to a non-latching relay switch assembly, in general, and to such a non-latching switch assembly in which the coil section is hermetically separated from the switch section, in particular.

2. Prior Art

There are many types of switches and relays which are known in the art. These switches and relays are often arranged together to form a solenoid or the like. The electrical relay is, generally, a device which utilizes the variation of current in one electric circuit as a controlling factor in another. For example, a change in current in one circuit may cause or permit a current in another circuit, in response to the operation of an intermediate relay. The relays, switches and/or solenoids which are known in the art are too numerous to discuss herein. These relays have been widely used, particularly in automatic or semi-automatic devices, for the protection or operation of electric power equipment, or for communication systems. Suitable relays may detect over-current, under-current, over-voltage, under-voltage, overload, reverse current, reverse power, abnormal frequency, high temperature, short circuits, phase unbalance, or the like. Relays may be highly specialized protective relays which will detect an abnormality and, for example, open (or close) a circuit associated with the abnormality. Commonly, relays are used as a means to direct current from an electrical supply to a load circuit.

However, the known and existing relay switches have certain shortcomings when constructed as a single chambered, unitary device. In many applications, this is a problem because of the potential for interaction between the control circuits (i.e. coils) and the switching circuits and armature. Also, it is possible that the switching portion of the device can be contaminated by the components and materials which are utilized in the coil section. Thus, even in hermetically sealed devices, failures due to corrosion or the like can occur. The outgas or vapor products associated with the commonly used organic materials required for coil construction have historically caused organic films to occur on the contact surfaces of the switches which cause high contact resistance and, in some cases, even cause open circuits. Likewise, particulate shedding from the coil assembly can also be a problem. Also, the known and existing relays of subminiature configurations commonly stick in a null position because of friction in the armature suspension system. Consequently, an improved design of the assembly is required.

PRIOR ART SUMMARY

A preliminary search of the prior art was not conducted with regard to this invention.

CO-PENDING APPLICATION

Reference is made to the co-pending application entitled LATCHING RELAY SWITCH ASSEMBLY by F. A. Duimstra, bearing Ser. No. 07/399,076 and filed on Aug. 28,1989.

SUMMARY OF THE INSTANT INVENTION

This invention is directed to a non-latching relay switch wherein the magnetic portion (including magnets, cores, coils) of the assembly is separated from the switch portion (including armature and contacts). This arrangement permits those components which include organic compounds to be isolated from the sensitive electrical contacts.

By selectively arranging the cores, coils and magnets, a non-latching relay operation is provided. For example, an electromagnet including a core of soft magnetic material and a coil of wire thereon are, essentially, centrally located in the magnetic portion of the assembly. A permanent magnet is offset to one side of the coil. A passive pole piece is joined to the upper ends of the core and the permanent magnet. The passive pole piece also includes a portion thereof which is disposed on the opposite side of the coil from the permanent magnet.

An armature in the switch portion of the assembly is mounted to be normally attracted to the permanent magnet. The armature is selectively attracted to the passive pole piece only when a control signal is supplied to the electromagnet coil. The position of the armature determines the electrical connections performed by the contacts of the switch portion of the relay switch. In addition, the armature in the switch portion of the device can be suspended on a taut-band suspension or it can be pivoted on pin mountings in order to avoid a neutral or null position of the armature.

In the preferred embodiment, the entire relay switch is mounted within a single, hermetically sealed, housing but separated by an impervious interface membrane between the coil section and the armature section.

BRIEF DESCRIPTION OF THE DRAWINGS

FIG. 3A is a schematic, cross-sectional representation of the non-latching relay shown in the normal, unactivated state.

FIG. 3B is a schematic, cross-sectional representation of the non-latching relay in the activated state.

FIG. 4 is a schematic, isometric representation of the magnetic portion of the non-latching relay of the instant invention.

FIG. 5 is a schematic, partially broken away representation of the contact portion of the non-latching relay of the instant invention.

DESCRIPTION OF THE PREFERRED EMBODIMENT

Figure 1:
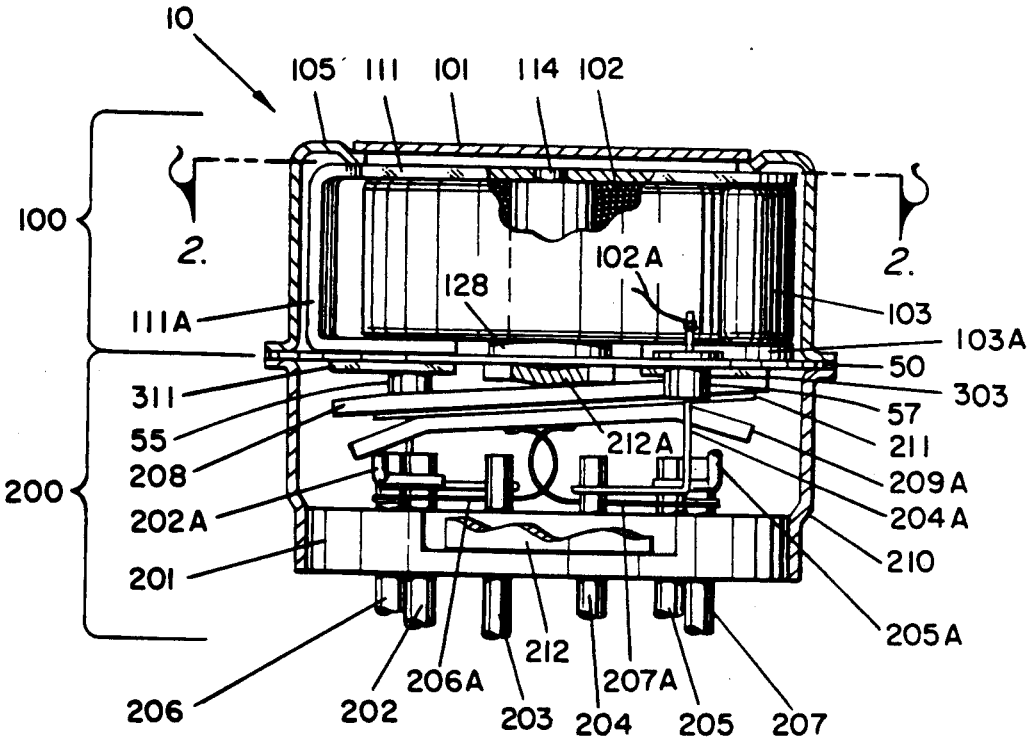
FIG. 1 is a schematic, partially cross-sectional, partially broken-away, side view of the non-latching relay switch of the instant invention.

Referring now to FIG. 1, there is shown a simplified schematic, but representative, cross-sectional view of the non-latching relay switch 10 of the instant invention.

In this embodiment, it is clear that the relay switch apparatus 10 is comprised of two separate and distinct sections or components. One section is the coil assembly 100 (also referred to as the magnetic portion of the switch). The other section of the apparatus 10 is the switch assembly 200. These two sections are completely separate and sealed off from each other by means of a suitable membrane 50. Typically, membrane 50 is fabricated of 304L Stainless Steel. The same non-magnetic material is used in the housing components 105 and 210, the lid 101 and the header 201. Membrane 50 is impervious to all gases including helium which is used as a leak detection gas. Inasmuch as the coil assembly 100 is constructed, sealed and leak tested separately, any of the organic and gaseous products associated therewith are sealed within the enclosure members of assembly 100. This construction ensures that any organic materials which may be used in the fabrication of the coil assembly 100 cannot contaminate the contact surfaces of the switch assembly 200.

In this embodiment, switch assembly 10 is substantially identical to the switch assembly shown, described and claimed in the co-pending application by F. A. Duimstra, noted above. However, the assembly 200 will be described briefly for completeness. Thus, the base of the assembly is fabricated of a header 201 which is, typically, formed of 304L stainless steel. A plurality of pins 202 through 205 extend through the header 201. The pins are fabricated of Alloy 52 with a copper core. A separate glass-to-metal seal 299 (see FIG. 5) is used to mount each of the pins in the header 201 In the view shown in FIG. 1, only six pins are visible. However, in the actual working embodiment, and as shown in other views, up to ten (10) pins are used for the aforementioned co-pending application and up to eight (8) pins in this working embodiment. It is understood that any number of pins (within volume restrictions) can be utilized. Typically, these pins provide six connections for the two switched contact pairs and two connections for the coil drive (as described hereinafter). For example, in the application shown in FIG. 1, pin 202 represents a normally closed contact and pin 205 represents a normally open contact. That is, these pins are normally in contact with (or not) the common contact member 209, as shown. Similarly, pins 293 (see FIG. 5) and 204 represent the connections made to the coil 102 via connectors 293A and 204A, respectively. Pins 206 and 207 represent the common connections to the movable contacts 209A and 209B via connectors 206A and 207A (see FIG. 5).

The connections to the switch mechanism are made directly via the header pins 202, 206, 205 (1st Form C Contact), and 292, 207, 295 (2nd Form C Contact) See FIG. 5 for pins 292 and 295 which are hidden from view on FIG. 1. The connections to the coil 102 are carried from the header pins 204 and 293 through the switch assembly cavity 200 via connectors 204A and 293A, respectively, to glass-metal feedthroughs 55 and 57 which pass through the interface membrane 50. The connection to the coil 102 is made on the coil assembly side 100 of the feedthroughs 55 and 57.

More particularly, the coil assembly 100 is fabricated by assembling a coil 102 on a soft magnetic core 114. The coil assembly is mounted on the interface membrane 50. The coil 102 is made of magnet wire, for example, of the 220 class, type M, while the core 114 is made of soft magnetic low carbon iron Carpenter Consumet-vacumet, electrical iron, or Hyperco 50 Alloy, for example. The lower end of core 114 abuts a passive pole plate 128 which is mounted on the coil side of membrane 50.

The coil connections, for example, connection 102A, are made via the feedthroughs 55 and 57 as noted above. The connections are produced, typically, by means of resistance welding the coil lead wire 102A to the terminal of feedthrough 57. Where the interface membrane 50 is penetrated by the feedthrough 57 (or 55) the interface membrane 50 is sealed to the feedthrough by means of laser welding, for example.

A permanent magnet 103 is mounted to one side of coil 102 and includes an enlarged pole piece 103A on the coil side of the membrane 50. In a preferred embodiment, the permanent magnet is formed of Alnico or similar and equivalent material.

The upper bridge 111 substantially J-shaped and is fabricated of a soft magnetic, low carbon metal such as Carpenter Consumet-vacumet electrical iron. The end of the longer arm of bridge 111 is placed on the upper end of the permanent magnet 103. The midpoint of the longer arm of bridge 111 is connected to the end of the magnet core 114. The shorter arm of bridge 111 is disposed under coil 102, on the surface of membrane 50. This portion of bridge 111 operates as a passive pole piece for the coil assembly. The bottom 111A (actually a vertical side member) of the J-shaped bridge 111 is disposed on the opposite side of coil 102 relative to permanent magnet 103.

When the coil 102 is in place and fully checked out, the upper housing 105 is placed over the coil assembly 100 and sealed to the interface membrane 50 by means of laser welding around the perimeter of the membrane. When again checked for functional operation, the coil housing 105 is filled with suitable encapsulating materials such as an epoxy (Epon 828, with Z Hardener with Mica filler, a formation that has proven compatible with encapsulation of coil assemblies). A disk or lid 101 is then placed at the opening of the housing 105 and is laser welded thereto. The coil assembly 100 is then checked for hermeticity by any suitable method, preferably using a helium bomb/mass spectrometer method, e.g. MIL-STD-202F Method 5.4.3., procedure IIIa.

Figure 2:
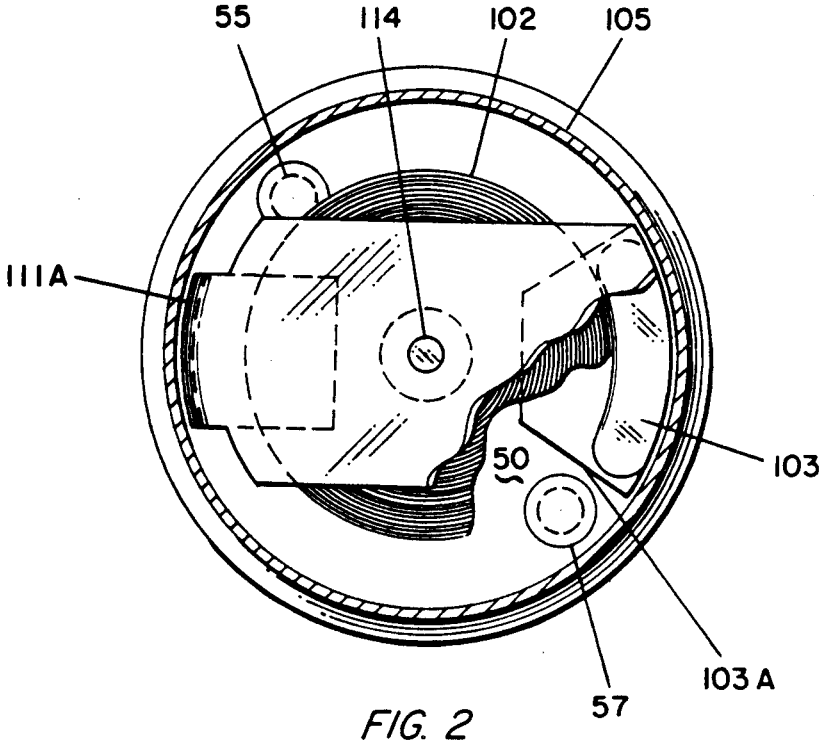
FIG. 2 is a schematic, partially cross-sectional, partially broken-away top view of the non-latching relay shown in FIG. 1.

The lower bridge 212 includes a grooved or angled center portion 212A as seen in FIGS. 1, 2 and 4. Relatively flat or planar ends of lower bridge 212 are arranged to support the membrane 50. The lower bridge 212 also provides a flux return path for the permanent magnet.

The stationary switch connectors 202A and 205A are welded to the appropriate pins, in this case pins 202 and 205, mounted in the header 201. The moving portion of the switch mechanism, i.e. armature 208, is attached to the common contacts 209A and 209B (See FIG. 5). A layer 211 of insulation such as Kapton with Pyralux 222 is disposed between contacts 209A and 209B and armature 208. The moving switch assembly is pivoted to the lower support bridge 212. The lower bridge assembly is placed over the header 201 and the ends of bridge 212 (shown broken away) are spot welded in place at the sides of header 201.

The ends of the contacts 209A and 209B bear on the fixed contact 202A, 292A, 205A and 295A welded to the pins 202, 205, 292 and 295 in the header 201. These contacts are also gold-plated Consil 995 drawn wire or pure silver wire, which are processed to assure freedom from inclusions and fissures. The common connections 209A and 209B are brought from each contact on the armature, through coiled copper straps 206A and 207A, to the appropriate header pins 206 and 207. The two straps are mounted and coiled in opposition, so that any resultant torques on the armature 208 are cancelled.

The coil connections 293A and 204A are connected from pins 293 and 204, are spot welded to feedthroughs 55 and 57 in the interface membrane 50. The switch assembly cover 210 is then placed over the header 201 and laser welded to the perimeter of the interface membrane 50 and the lower perimeter of the top cap 105. The switch assembly cover 210 is then laser welded to the perimeter of the header 201. The placement and welding of the cover 210 is accomplished in a chamber containing the correct mixture of gases such as 10% helium, 5% oxygen with the remainder dry nitrogen.

The pole faces 311 and 303 are disposed below the membrane 50. The pole faces 311 and 303 include dimples or recesses which are arranged to receive mating protrusions which extend from the bottom surface of the short arm of bridge 111 and from the bottom surface of pole piece 103A. These protrusions extend through the membrane 50 but are sealed thereto by laser welding in order to maintain the hermetic integrity of the apparatus.

Referring now to FIG. 2, there is shown a partially cross sectional, partially broken away representation of the coil portion of the invention taken from the top of the assembly. The housing 105 surrounds the coil 102 which is wound on core 114. The coil and core are substantially centrally located within the housing 105. The permanent magnet 103 is shown as sausage-shaped and disposed between the housing 105 and the coil 102. This arrangement of magnet 103 provides for the most efficient utilization of space in the apparatus. The lower pole piece 103A is disposed between the lower surface of coil 102 and the upper surface of membrane 50. The upper bridge 111 overlies the upper end of permanent magnet 103, and joins with the upper end of core 114. The side (or bottom IIIA of the J-shaped unit shown in FIG. 1) is disposed on the opposite side of the coil relative to magnet 103.

The relationship of the feedthroughs 55 and 57 relative to the coil 102 is also shown in FIG. 2.

Referring now to FIGS. 3A and 3B there is are shown schematic representations of the internal components of the coil assembly 100 and the switch assembly 200 in the relay switch 10. In this embodiment, components similar to other components bear similar reference numerals. In the embodiments shown in FIGS. 3A and 3B, the outer housings 105 and 210, as well as the membrane 50 have been removed for convenience.

The non-latching relay configuration of this invention includes an electromagnet including the core 114 and the coil 102 as well as a permanent magnet 103. The coil assembly is configured to permit the largest possible coil winding volume with the core 114 at the center of the unit and the diameter of coil 102 almost equal to the inner diameter of housing 105 (see FIGS. 1 and 2). As shown in FIG. 3A, the armature 208 is normally magnetically attracted to permanent magnet 103 which is disposed to the side of and around a portion of coil 102 and has in its magnetic flux path the upper bridge 111 and the core 114. The armature 208 is normally held in the position shown in FIG. 3A as a result of the flux generated by permanent magnet 103. The armature 208 is centrally pivoted so that the right gap is essentially zero and the left gap is large. The attractive force caused by the opposite magnetic polarity operating across the minimal gap at the lower pole of permanent magnet 103 is orders of magnitude higher then the attractive force operating across the maximum gap at the lower pole of passive pole piece 111A. Thus, the relay armature 208 and the contacts 209A and 209B attached thereto are retained in the position shown.

The relay is switched, as shown in FIG. 3B, by applying an electrical pulse to coil 102. The electrical pulse produces a magnetic flux in core 114 which opposes the flux polarity caused by the permanent magnet 103. Thus, the electromagnet flux induces a repulsion force at the lower pole of magnet 103. Conversely, an attraction force is established at the lower pole of passive pole piece 111. If the duration of the pulse on coil 102 is long enough for the armature 208 to rotate in the clockwise direction and move through the mid-position, the armature 208 moves into engagement with pole piece 111 as shown in FIG. 3B. The armature 208 remains in the switched position shown in FIG. 3B only so long as electrical power is supplied to the coil 102. Thus, when the electrical power is removed from coil 102, the electromagnetic flux in core 114 is terminated whereupon the flux produced by the permanent magnet 103 prevails and attracts armature 208 to the original position.

As noted, supra, to permit maximum volume for the electromagnetic coil 102, the permanent magnet 103 is positioned off the center-line of the relay and accurately configured around the perimeter of the coil 102. The flux from the upper end of the permanent magnet is brought to the top of the coil core 114 by the upper bridge 111. The flux from the lower end of the permanent magnet 103 is brought to the passive pole piece for attracting the armature 208. The upper bridge 111 completes the magnetic path.

The mathematical model indicates the feasibility of relying on the permanent magnetic forces to return the armature 208 to its original position. However, in an alternative embodiment shown in FIG. 3A a small return spring 350 and/or a non-magnetic shim 351 between the armature 208 and the lower pole 311 of the upper bridge 111 may be desirable to give proper drop-out current characteristics.

As suggested in FIG. 3A, spring 350 can be mounted adjacent the edge of bridge section 111A. The armature 208 is arranged to extend past the bridge 111 so as to engage the lower arm of the spring 350. Thus, when the electrical signal is supplied to coil 102, armature 208 rotates as described above. The magnetic force applied by pole piece 111 is sufficient to attract armature 208 and compresses spring 350. When the electrical signal is removed, the spring 350 applies sufficient mechanical force to move armature 208 in the counterclockwise direction. This spring-loaded action can assist in returning the armature to the "normal" position.

In a similar fashion, a thin non-magnetic shim 351 can be placed at the lower pole piece 111 (or 311). This will reduce the magnetic attraction between the pole piece and the armature 208 when the electrical signal is removed from coil 102. Of course, the shim 351 or a similar component can be mounted on the armature 208 to create the same effect. However, with this arrangement it may be somewhat more difficult to balance the armature 208 on the fulcrum.

Referring now to FIG. 4, it is seen that the permanent magnet 103 is positioned off the center-line of the relay. By moving the permanent magnet off the centerline, the coil diameter can almost equal the internal diameter of the housing. This allows the coil design to use heavier, more rugged wire and to lower the current consumption of the coil drive. The flux from the upper end of the permanent magnet 103 is brought to the top of the coil core 114 and to the top of the passive pole 111A by the upper bridge 111. The flux from the lower end of the permanent magnet 103 is brought to the lower pole piece 103A. The flux from the coil core 114 is brought to the fulcrum of the armature by a passive pole plate 128 (on the coil assembly side of the interface membrane 50) and to the lower bridge 212A (on the switch assembly side of the interface membrane 50). The armature 208 completes the magnetic pathway.

The electromagnetic coil 102 is wound on the soft magnetic core 114, the ends of which fit into recesses on the upper bridge and on the passive pole plate 128. The pole plate has circular protrusions at each end which project through the membrane 50 (and are sealed by laser welding) to mate with the surface of the lower bridge within the switch assembly cavity.

Referring now to FIG. 5, there is shown a switch assembly which is useful in this apparatus. Reference is made to the co-pending application of F. A . Duimstra, noted above, for additional details of the switch assembly. The description in the co-pending application is incorporated herein, in its entirety, by reference thereto.

The fixed elements of the switch assembly are supported on the terminals of the header 201. The moving armature assembly 208 is supported from the lower support bridge 212, which is joined to header 201.

The lower support bridge 212 performs a number of important functions. It permits the coil assembly 100 to be permanently mounted over the switch assembly, thereby to ease assembly and adjustment. It also constitutes an element of the magnetic path, conducting flux from the magnets and to the fulcrum of the armature. Also, the center of the bridge functions as the armature fulcrum, tightly integrating the mechanical and magnetic designs.

The armature 208 comprises a soft magnetic iron bar, for example Carpenter Consumet Vacumet Electrical Iron, which has low remanent magnetic polarization to reduce magnetic hysteresis. The armature 208 supports the independent switching contacts 209A or 209B made of gold-plated silver (e.g. drawn and rolled Consil 995 wire or pure rolled silver). This silver or silver alloy assures surface finishes which are free from fissures and inclusions that could trap processing fluids and other contaminants. The switching contacts 209A and 209B are mounted to, and isolated from, the armature 208 by a PyraLux/Kapton layer 211 which will not outgas at the maximum operating temperature. The contacts 209A and 209B have, in this embodiment, the ends thereof ambulated to provide a wiping contact with the stationary contacts 202A, 292A, 205A and 295A (see FIG. 5).

Figure 6:
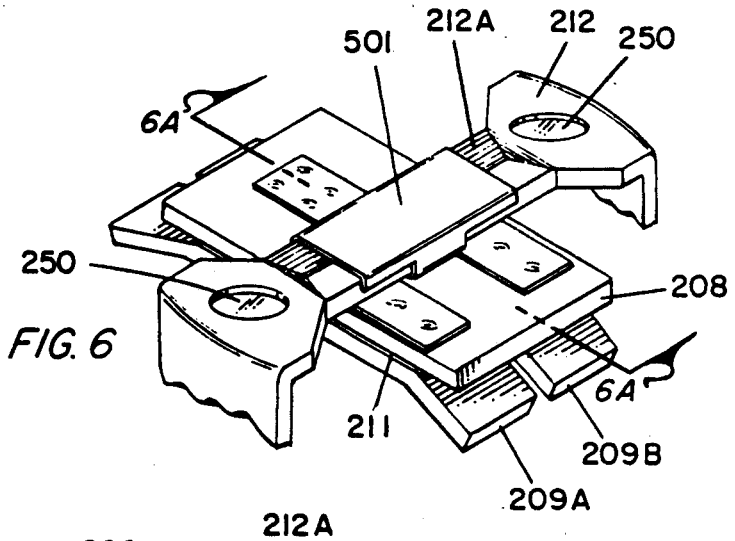
FIGS. 6 and 6A are schematic, partially broken away representations of the taut-band armature suspension system.
Figure 6A:
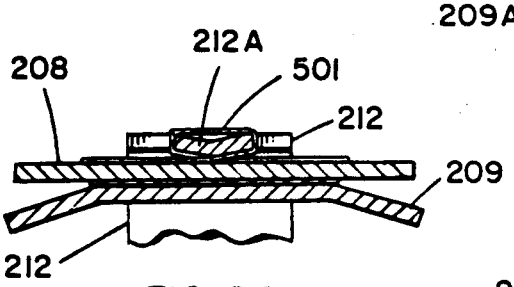

As shown in FIG. 6, the armature 208 is supported from the lower bridge 212 by a modified taut-band suspension 501. In this suspension, a thin band 501 of soft magnetic iron is tightly wrapped around the middle of the lower bridge 212 and welded to the armature 208. The middle section 512 of the lower bridge includes a slightly V-shaped configuration to act as a fulcrum for the armature 208. This suspension arrangement provides virtually friction-free operation and eliminates the possibility of the armature finding a neutral null position under any circumstance.

The magnetic circuit which originates within the coil assembly connects to the armature through the fulcrum and the two pole pieces. The surfaces of these elements are shaped to provide maximum flux area, minimum airgap, and low flux leakage.

In the assembly sequence the fixed contacts 202A, 292A, 205A and 295A are first welded to the header pins 202, 205, 292 and 295. The armature assembly is mounted to the lower support bridge by means of the taut band as previously described. The lower bridge is then welded to the header. The common straps and the coil terminal feedthroughs are then welded to the header pins. The finished coil assembly is mounted and welded to the lower support bridge.

Figure 7:
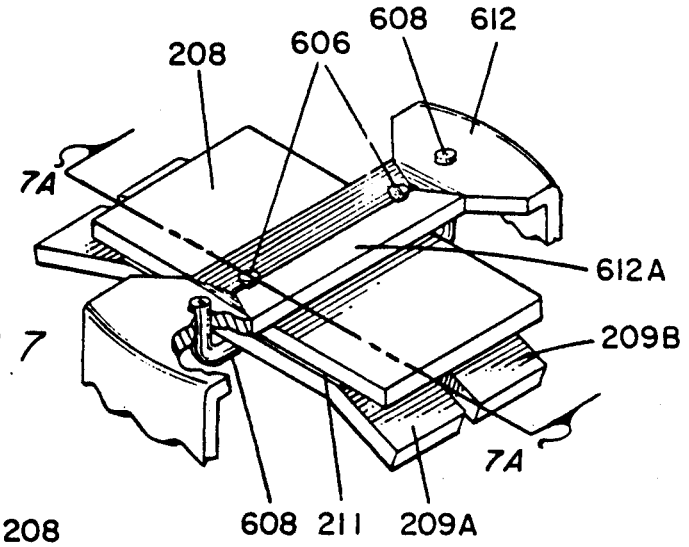
FIGS. 7 and 7A are schematic, partially broken away representations of the pin/pivot armature suspension system.
Figure 7A:
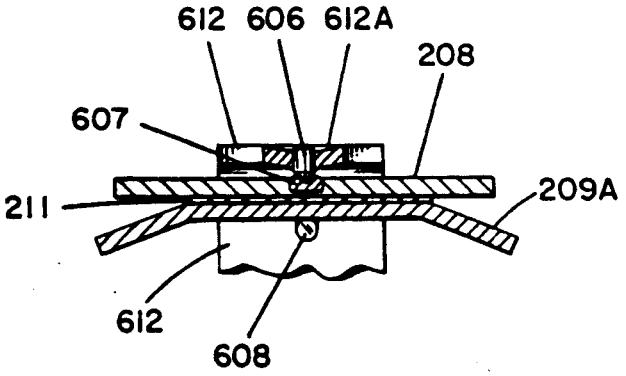

Referring now to FIG. 7, there is shown an alternate low friction armature suspension system. This suspension uses two sharply pointed pins 606 which protrude from the lower bridge 612. The pins 606 are laser welded into the bridge 612 from the back. The armature 208 includes cone shaped cavities 607. The final piercing and control of the clearance between the lower bridge 612 and the armature 208 is provided by placing a thin metal assembly shim between the components and forcing the armature onto the bridge pins until bottomed out on the shim. The shim is then removed, resulting in a controlled small clearance between the armature and the lower bridge, and a custom fit between the pins 606 and the conical shaped cavities 607 in armature 208.

The magnetic circuit which originates within the coil assembly, connects to the. armature through the fulcrum and the two pole pieces 311 and 303B (FIG. 1). The surfaces of these elements are shaped to provide maximum flux area, minimum air gap, and low flux leakage.

In operation, the magnetic attraction of the armature to the bridge holds the armature in place except under extreme shock and acceleration levels. Limit stops 608 are provided to prevent complete disengagement of the pivot pins from the conical cavities during shock and acceleration. The pivot tends to be re-seated by the magnetic field after the removal of any acceleration.

Thus, there is shown and described a unique design and concept of a switching relay assembly. The particular configuration of the switch assembly shown and described herein relates to a non-latching configuration. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A non-latching switch apparatus comprising, coil assembly means, said coil assembly means includes at least one permanent magnet means and at least one electromagnet means, said electromagnet means includes at least one coil winding mounted on a soft magnetic core, said coil assembly means includes magnetic flux return path means having one end thereof joined to said permanent magnet means and approximately the midpoint thereof joined to said magnetizable core of said electromagnet means, switch assembly means, housing means surrounding said coil assembly means and said switch assembly means, and membrane means joined to said housing means and disposed between said coil assembly means and said switch assembly means.

2. The apparatus recited in claim 1 wherein, said housing means is hermetically sealed to said membrane means.

3. The apparatus recited in claim 1 wherein, said housing means includes a header means adjacent to said switch assembly means.

4. The apparatus recited in claim 3 including, a plurality of contact means mounted in said header means.

5. The apparatus recited in claim 1 including, support bridge means joined to said housing means.

6. The apparatus recited in claim 1 wherein, said membrane means is impervious to gases.

7. The apparatus recited in claim 1 wherein, said switch assembly means includes armature means which is selectively positioned by said coil assembly means.

8. The apparatus recited in claim 7 including, mounting means for mounting said armature means adjacent to said coil assembly means.

9. The apparatus recited in claim 8 wherein, said mounting means includes a taut-band suspension system.

10. The apparatus recited in claim 8 wherein, said mounting means includes a pivot-pin suspension system.

11. The apparatus recited in claim 4 including, feedthrough connectors mounted in said membrane means and connecting said contact means in said header means to said coil assembly means.

12. The apparatus recited in claim 1 wherein, said permanent magnet is displaced from the center of said coil assembly means.

13. The apparatus recited in claim 7 wherein, said armature means is pivotally mounted in said switch assembly means.

14. The apparatus recited in claim 1 wherein, said membrane means is substantially rigid and transmits electromagnetic energy therethrough.

15. The apparatus recited in claim 7 wherein, said armature means is mounted to pivot about its center.

16. The apparatus recited in claim 7 wherein, said armature means includes contact means mounted on a magnetic support.

17. The apparatus recited in claim 1 wherein, aid soft magnetic core and said permanent magnet are arranged with the axes thereof parallel to each other.

18. The apparatus recited in claim 8 wherein, said mounting means is disposed on the switch assembly side of said membrane means.

19. The apparatus recited in claim 1 wherein, said armature means includes a support member of magnetic material, and electrical contact means mounted on said support member.

20. The apparatus recited in claim 19 including, insulating material interposed between said support member and aid electrical contact means.

21. The apparatus recited in claim 19 wherein, said armature means selectively makes electrical connection with at least one of said contact means as a function of the position of said armature means.

22. The apparatus recited in claim 19 wherein, said electrical contact means are connected to torsion spring connectors to minimize the torque applied to said armature means.

23. The apparatus recited in claim 5 wherein said support bridge means includes a V-shaped portion thereof which serves as a fulcrum for said armature means.

24. A non-latching relay switch comprising, an electromagnetic coil mounted on a core of magnetic material, a permanent magnet disposed adjacent to one side of said coil, a J-shaped flux path comprising first , second and third legs, said first leg joined to the top ends of each of said core and said permanent magnet, said second leg joined to said first leg and disposed parallel to said permanent magnet, said third leg joined to said second leg and disposed parallel to said first leg, said second and third legs forming a passive magnetic pole and pole piece, a pivotally mounted armature which by pivoting, selectively engages at a given time the bottom end of one of only said permanent magnet and said third leg of said flux path, and contact means adapted to make an electrical connection dependent upon the position of said armature.

25. The switch excited in claim 24 including, a membrane disposed below said flux path means and said second coil.

26. The switch recited in claim 24 wherein, said membrane means is comprised of a non-magnetic metal.

27. The switch recited in claim 24 wherein, said contact means is formed of an electrically conductive metal.

28. The switch recited in claim 26 including, header means, said header means is formed of a non-magnetic metal, and said contact means passes through said header means and is sealed in place by a non-conductive glass-to-metal seal.

29. The apparatus recited in claim 24 wherein, said flux path means transfers magnetic flux from said permanent magnet to said magnetic core.

30. The apparatus recited in claim 1 wherein, said housing means includes an upper housing and a lower housing, aid upper housing encloses said coil assembly means, said lower housing encloses said switch assembly means, each of said upper and lower housing is hermetically sealed to said membrane means.

31. The switch recited in claim 7 wherein, said armature remains latched to said permanent magnet until a signal is supplied to said coil to thereby alter the flux in said flux path thereby to cause said armature to move to a latched position at the other of said first and second cores.

32. The apparatus recited in claim 1 wherein, said permanent magnet means comprises an arcuate permanent magnet disposed adjacent to the periphery of said coil winding.

* * * * *